US009086655B2

(12) United States Patent
Uno et al.

(10) Patent No.: US 9,086,655 B2
(45) Date of Patent: Jul. 21, 2015

(54) DEVELOPING DEVICE

(71) Applicant: Brother Kogyo Kabushiki Kaisha, Nagoya-shi, Aichi-ken (JP)

(72) Inventors: Takanori Uno, Nisshin (JP); Kazuna Taguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/309,263

(22) Filed: Jun. 19, 2014

(65) Prior Publication Data

US 2014/0376954 A1 Dec. 25, 2014

(30) Foreign Application Priority Data

Jun. 21, 2013 (JP) ..... 2013-130896

(51) Int. Cl.
*G03G 15/08* (2006.01)

(52) U.S. Cl.
CPC ..... *G03G 15/0898* (2013.01); *G03G 15/0817* (2013.01)

(58) Field of Classification Search
CPC ..... G03G 15/0898; G03G 15/0817
USPC ..... 399/103, 105
See application file for complete search history.

(56) References Cited

U.S. PATENT DOCUMENTS

| | | | | |
|---|---|---|---|---|
| 6,792,227 | B2 * | 9/2004 | Itabashi | 399/105 |
| 7,336,913 | B2 * | 2/2008 | Sato et al. | 399/103 |
| 7,706,715 | B2 | 4/2010 | Mori et al. | |
| 8,041,250 | B2 | 10/2011 | Matsushita | |
| 2007/0223958 | A1 | 9/2007 | Mori et al. | |
| 2009/0226207 | A1 | 9/2009 | Matsushita | |

FOREIGN PATENT DOCUMENTS

| | | | |
|---|---|---|---|
| JP | 2000-235304 | A | 8/2000 |
| JP | 2007-256873 | A | 10/2007 |
| JP | 2009-063635 | A | 3/2009 |

* cited by examiner

*Primary Examiner* — Hoang Ngo
(74) *Attorney, Agent, or Firm* — Banner & Witcoff, Ltd.

(57) ABSTRACT

A developing device includes a casing configured to accommodate developer, a developing roller, a seal member, at least a portion of which is disposed between the developing roller and the casing, the seal member including a fabric member having plural fibers extending in a first direction and plural second fibers extending in a second direction, wherein the plural first fibers and the plural second fibers are intersecting each other, and each of the fibers of the fabric member include a circumferential surface which has a first heat radiation amount per unit area, and an end surface having a second heat radiation amount per unit area larger than the first heat radiation amount, and a heat radiation member disposed at an end portion of the seal member in an axial direction of the developing roller and is configured to contact the end surfaces of the fibers.

10 Claims, 8 Drawing Sheets

DEVELOPING DEVICE

CROSS-REFERENCE TO RELATED APPLICATION

This application claims priority from Japanese Patent Application No. 2013-130896, filed on Jun. 21, 2013, the entire subject matters of which are incorporated herein by reference.

TECHNICAL FIELD

Aspects of the present invention relate to a developing device including a seal member for suppressing leakage of developer from a gap between a developing roller and a casing.

BACKGROUND

There has been known a developing device which includes a casing configured to accommodate toner, a developing roller disposed to face an opening formed in the casing, and a seal member disposed between end portions of the developing roller and the casing (for example, JP-A-2009-63635).

Incidentally, in the above-described developing device, the developing roller comes into sliding contact with the seal member, whereby a sliding contact portion thereof is heated due to friction. Therefore, when a rotational speed of the developing roller is increased in order to increase a printing speed, the sliding contact portion becomes to have a high temperature and toner melts in the sliding contact portion, and thus there is a concern that toner leakage may occur.

SUMMARY

Accordingly, an aspect of the present invention provides a developing device which can radiate heat in a sliding contact portion between a developing roller and a seal member.

According to an illustrative embodiment of the present invention, there is provided a developing device including: a casing configured to accommodate developer; a developing roller; a seal member, at least a portion of which is disposed between the developing roller and the casing, the seal member including a fabric member having a plurality of first fibers extending in a first direction and a plurality of second fibers extending in a second direction different from the first direction, wherein the plurality of first fibers and the plurality of second fibers are intersecting each other, and each of the first fibers and the second fibers of the fabric member include a circumferential surface which has a first heat radiation amount per unit area, and an end surface having a second heat radiation amount per unit area larger than the first heat radiation amount; and a heat radiation member disposed at an end portion of the seal member in an axial direction of the developing roller and is configured to contact the end surfaces of the first fibers and second fibers.

According to the above configuration, since the heat radiation member comes into contact with the seal member, it is possible to allow heat generated at a sliding contact portion between the developing roller and the seal member to escape through the heat radiation member. Further, since the heat radiation member comes into contact with the end surface of the fabric member (the end surfaces of the first fibers and the second fibers), compared to, for example, a structure in which a heat radiation member comes into contact with only the circumferential surfaces of fibers configuring a planar surface of a fabric member, it is possible to allow heat transmitted to the fibers to efficiently escape to the heat radiation member. In addition, since the heat radiation member is disposed at an end portion of the seal member in an axial direction of the developing roller, it is possible to allow heat in the end portion of the seal member to efficiently escape.

Accordingly, it is possible to allow heat in the sliding contact portion between the developing roller and the seal member to escape.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1:
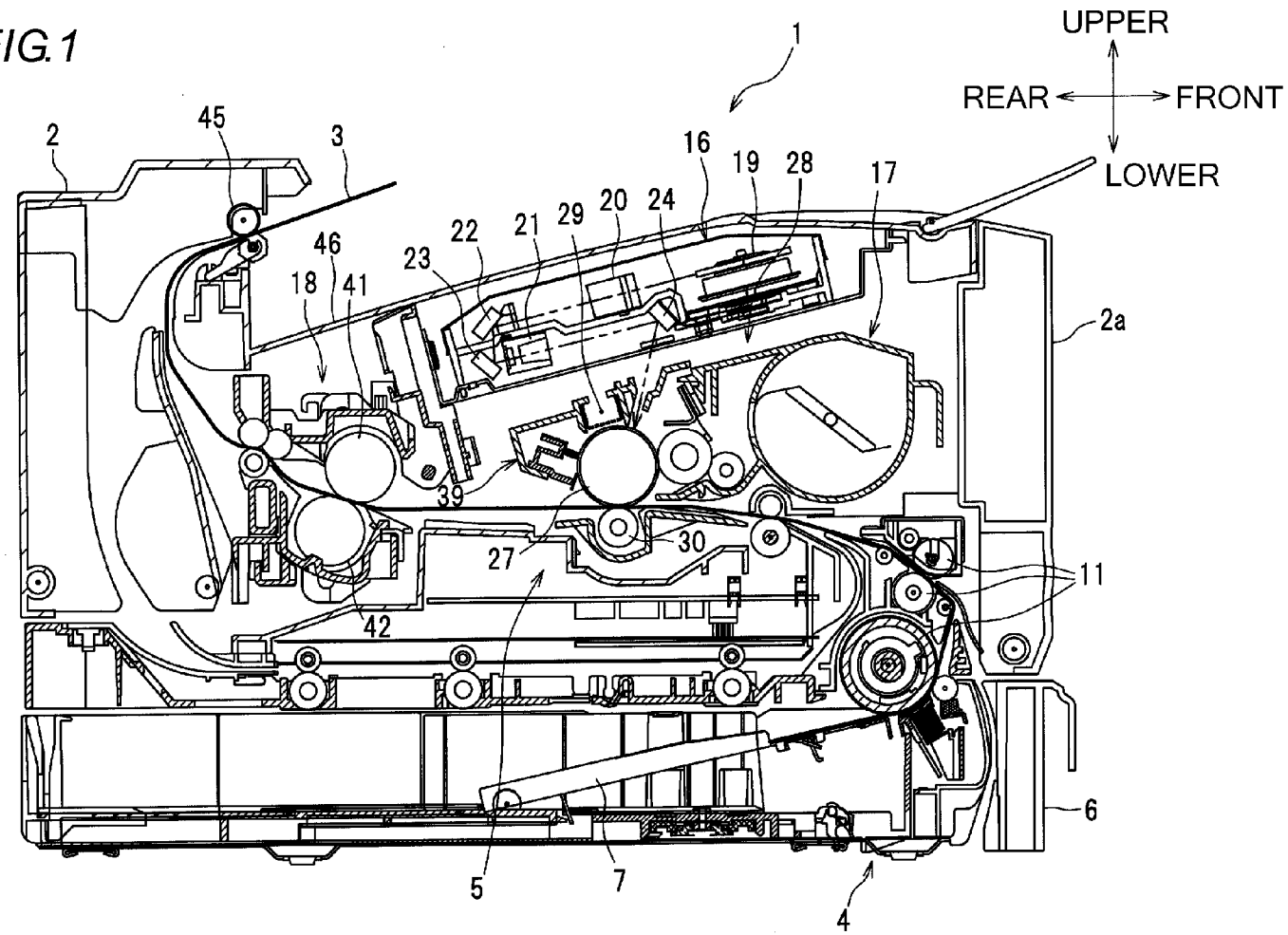
FIG. 1 is a cross-sectional view showing a laser printer including a developing cartridge according to an illustrative embodiment of the present invention.

Next, a first illustrative embodiment of the present invention will be described in detail appropriately referring to the drawings. In the following description, first, the overall configuration of a laser printer is briefly described, and thereafter, the details of illustrative embodiments of the present invention are described.

Further, in the following description, description will be made in direction based on a user during the use of a laser printer 1. That is, the right side in FIG. 1 is referred to as the "front", the left side is referred to as the "rear", the front side is referred to as the "left", and the back side is referred to as the "right". Further, a vertical direction in FIG. 1 is referred to as the "upper-lower direction".

As shown in FIG. 1, the laser printer 1 includes a main body casing 2, a feeder section 4 for feeding sheet 3, and an image forming section 5 for forming an image on the sheet 3.

The feeder section 4 includes a sheet feed tray 6 which is removably mounted on a lower portion in the main body casing 2, and a sheet pressing plate 7 provided in the sheet feed tray 6. Further, the feeder section 4 includes various rollers 11 which perform the transport of the sheet 3 or sheet dust removal. In the feeder section 4, the sheet 3 in the sheet feed tray 6 is pressed upward by the sheet pressing plate 7 and transported to the image forming section 5 by various rollers 11.

The image forming section 5 includes a scanner unit 16, a process cartridge 17, and a fixing section 18.

The scanner unit 16 is provided at an upper portion in the main body casing 2 and includes a laser emission section (not shown), a polygon mirror 19 which is rotationally driven, lenses 20 and 21, reflecting mirrors 22, 23, and 24, and the like. In the scanner unit 16, a laser beam is irradiated at high-speed scanning onto the surface of a photosensitive drum 27 along a path shown by a chain line in FIG. 1.

The process cartridge 17 is configured to be removably mounted to the main body casing 2 by appropriately opening a front cover 2*a* provided on the front side of the main body casing 2. Then, the process cartridge 17 includes a developing cartridge 28 (an example of a developing device), and a drum unit 39.

Figure 2:
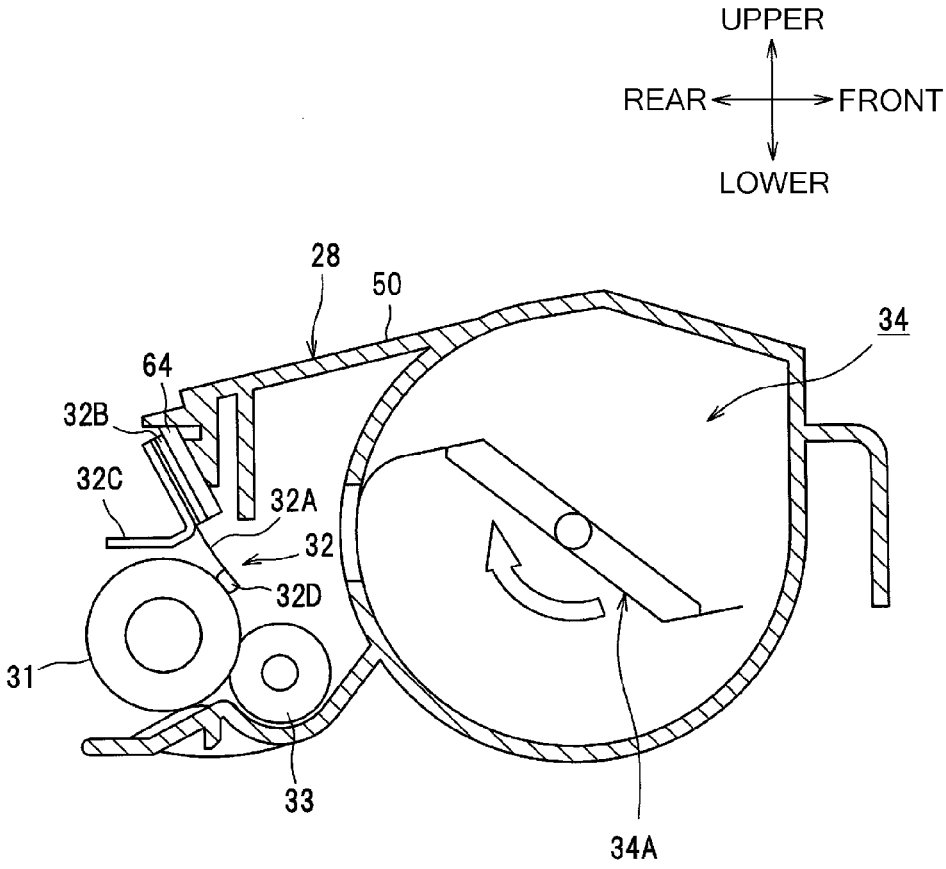
FIG. 2 is a cross-sectional view showing the developing cartridge.

The developing cartridge 28 is configured to be removably mounted to the main body casing 2 in a state of being mounted on the drum unit 39. The developing cartridge 28 may be configured to be removably mounted to the drum unit 39 which is fixed to the main body casing 2. The developing cartridge 28 includes a developing roller 31, a layer thickness regulating blade 32, a supply roller 33, and a toner accommodation chamber 34, as shown in FIG. 2.

In the developing cartridge 28, toner (an example of developer) accommodated in the toner accommodation chamber 34 is agitated by an agitator 34A and then supplied to the developing roller 31 by the supply roller 33, and at this time, the toner is positively frictionally charged between the supply roller 33 and the developing roller 31. The toner supplied onto the developing roller 31 enters between the layer thickness regulating blade 32 and the developing roller 31 with the rotation of the developing roller 31 and is carried on the developing roller 31 with the toner regulated to a thin layer having a constant thickness while being further frictionally charged. The details of the developing cartridge 28 will be described later.

As shown in FIG. 1, the drum unit 39 includes the photosensitive drum 27, a scorotron type charger 29, and a transfer roller 30. In the drum unit 39, the surface of the photosensitive drum 27 is uniformly positively charged by the scorotron type charger 29 and then exposed by high-speed scanning of a laser beam from the scanner unit 16. Accordingly, a potential of an exposed portion is lowered, whereby an electrostatic latent image based on image data is formed.

Subsequently, due to the rotation of the developing roller 31, the toner carried on the developing roller 31 is supplied to the electrostatic latent image which is formed on the surface of the photosensitive drum 27, and thus a toner image is formed on the surface of the photosensitive drum 27. Thereafter, the sheet 3 is transported between the photosensitive drum 27 and the transfer roller 30, whereby the toner image carried on the surface of the photosensitive drum 27 is transferred onto the sheet 3.

The fixing section 18 includes a heating roller 41 and a pressing roller 42 which is disposed to face the heating roller 41 and presses the heating roller 41. In the fixing section 18, the toner transferred onto the sheet 3 is thermally fixed while the sheet 3 passes through between the heating roller 41 and the pressing roller 42. In addition, the sheet 3 thermally fixed in the fixing section 18 is transported to a sheet discharge roller 45 which is disposed on the downstream side of the fixing section 18, and sent out from the sheet discharge roller 45 onto a sheet discharge tray 46.

<Detailed Structure of Developing Cartridge>

Next, the detailed structure of the developing cartridge 28 according to the first illustrative embodiment of the present invention will be described. Since the developing cartridge 28 has a bilaterally symmetric structure, in FIG. 3 and the like, only a portion on the left side is shown and illustration of a portion on the right side is omitted. Further, FIG. 3 shows a state where the developing roller 31, the supply roller 33, and an outer reinforcing plate 32C (refer to FIG. 2 and described later) are removed.

Figure 3:
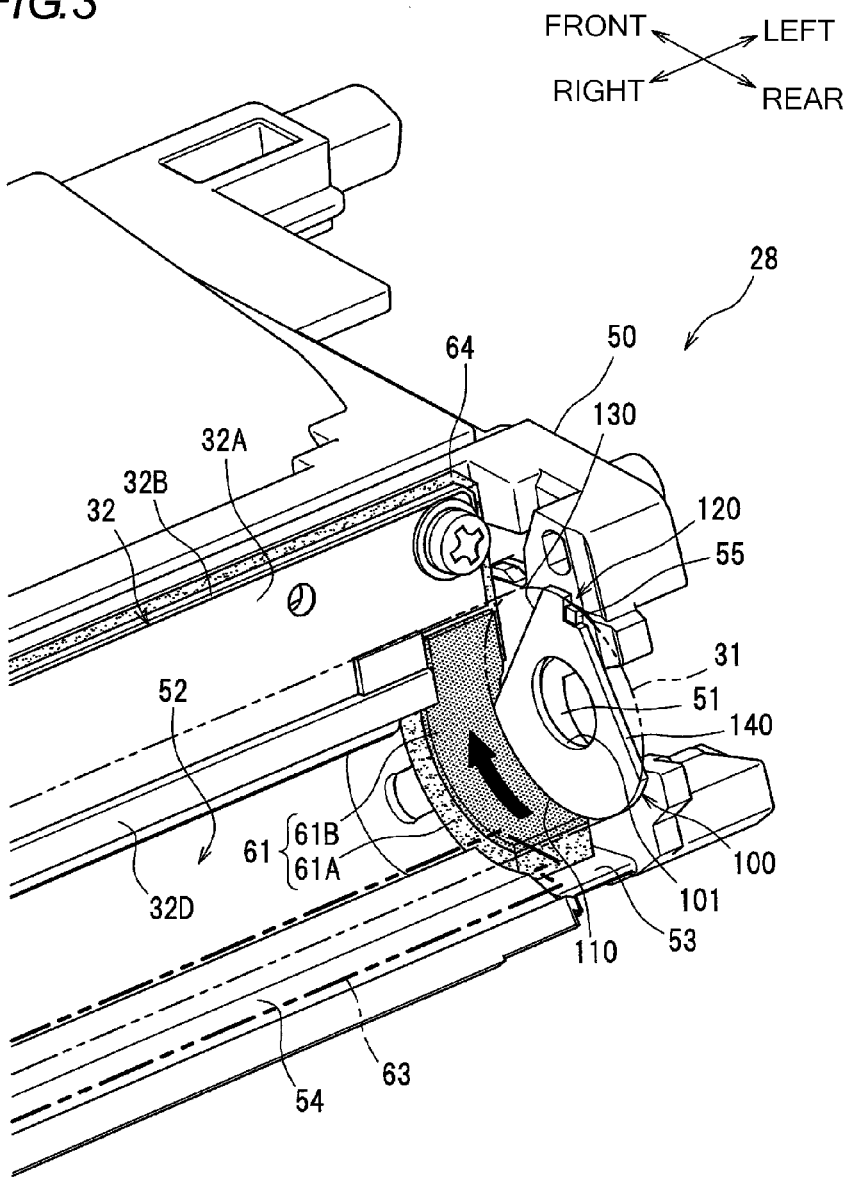
FIG. 3 is a perspective view showing a structure around an opening of a casing.

As shown in FIG. 3, the developing cartridge 28 includes a casing 50 for accommodating toner, a side seal member 61 (an example of a seal member) which comes into sliding contact with each of both end portions of the developing roller 31, a lower film 63, and a heat radiation member 100, in addition to the developing roller 31 and the like described above. The side seal member 61 and the heat radiation member 100 will be described in detail later. The developing roller 31 rotates in a direction of an arrow shown in the drawing, that is, rotates to come into sliding contact with the lower film 63 and the side seal member 61 in this order.

The casing 50 includes a bearing section 51 which rotatably supports the developing roller 31, an opening 52 for supplying toner from the toner accommodation chamber 34 on the inside to the developing roller 31, a side seal sticking surface 53 to which the side seal member 61 is stuck, a supporting section 54 which supports the lower film 63, and a protrusion 55 which suppresses the rotation of the heat radiation member 100. The opening 52 is formed into the form of a rectangular long hole along an axial direction of the developing roller 31, i.e. along a left-right direction, and the layer thickness regulating blade 32 is fixed to an upper portion thereof.

The layer thickness regulating blade 32 has a plate-shaped metal plate 32A which is long in the left-right direction, and a pressing member 32D which is made of rubber and fixed to a lower end portion (a tip end portion) of the metal plate 32A. The pressing member 32D is formed such that the left-right width thereof is smaller than that of the metal plate 32A. Further, both end portions in the left-right direction of the pressing member 32D are in contact with the side seal members 61.

As shown in FIG. 2, at an upper end portion (an end portion on the opposite side to an end portion coming into contact with the developing roller 31) of the layer thickness regulating blade 32, a pair of reinforcing plates 32B and 32C which sandwiches and reinforces the upper end portion therebetween is provided. The layer thickness regulating blade 32 and the pair of reinforcing plates 32B and 32C are fixed to the casing 50 with a known blade back seal 64 interposed therebetween. In other words, the outer reinforcing plate 32C sandwiches and holds the layer thickness regulating blade 32, the inner reinforcing plate 32B, and the blade back seal 64 between itself and the casing 50.

As shown in FIG. 3, the side seal sticking surface 53 is a surface having a substantially arcuate shape in a cross-sectional view, and the side seal sticking surfaces 53 are formed on both right and left sides of the opening 52. The side seal member 61 is provided on the side seal sticking surface 53.

The supporting section 54 is formed to protrude further to the developing roller 31 side than the side seal sticking surface 53 and extend along the axial direction of the developing roller 31. The lower film 63 is provided on the upper surface of the supporting section 54.

Figure 5:
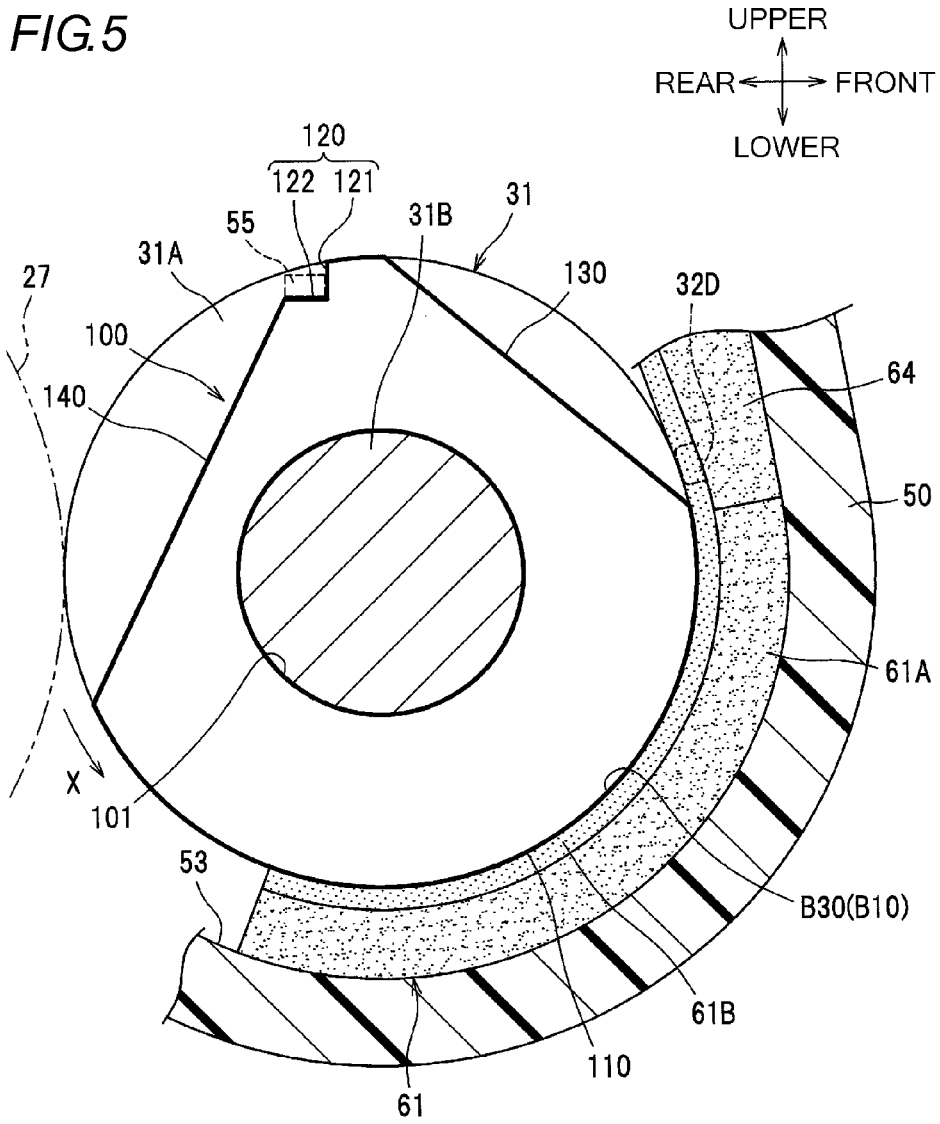
FIG. 5 is an enlarged cross-sectional view showing the periphery of a heat radiation member of the developing cartridge when viewed from the left side.

The protrusion 55 is formed to protrude toward the developing roller 31 side from the surface of the casing 50, which faces a side surface 31A of the developing roller 31 on each of right and left sides of the casing 50 (refer to FIG. 5). The protrusion amount of the protrusion 55 is set such that a tip thereof does not come into contact with the side surface 31A of the developing roller 31.

The lower film 63 is a sheet-like member made of resin such as polyethylene terephthalate and extends along the axial direction of the developing roller 31 to come into sliding contact with approximately the entirety of the developing roller 31. Then, the lower film 63 is formed longer in the left-right direction than the supporting section 54 and disposed such that in a state where the lower film 63 is stuck to the supporting section 54, both end portions thereof protrude from the supporting section 54, thereby overlapping the side seal members 61. Accordingly, toner leakage between the side seal member 61 and the lower film 63 is suppressed.

<Side Seal Member>

Figure 4A:
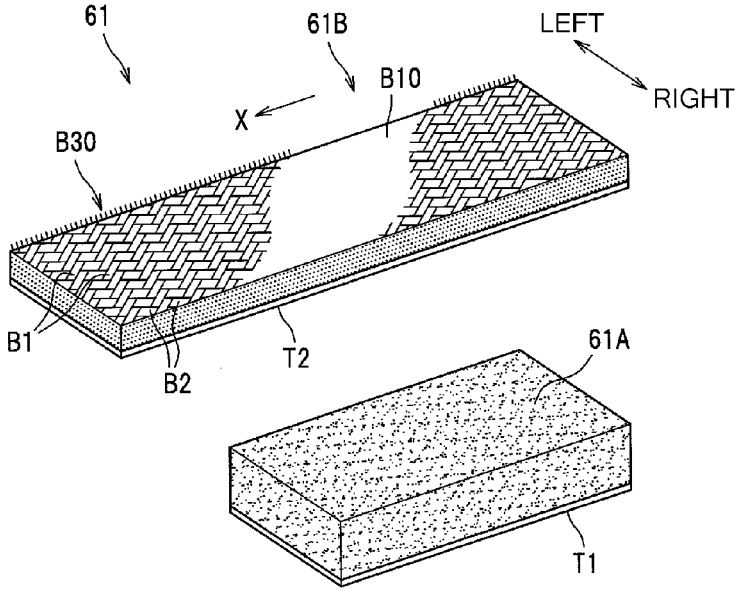
FIG. 4A is an exploded perspective view showing a side seal member in a simplified manner.

The side seal member 61 is a member for suppressing toner leakage from the gap between each of both end portions of the developing roller 31 which is disposed to face the opening 52 of the casing 50 and the side seal sticking surface 53, and is provided between each of both end portions of the developing roller 31 and the side seal sticking surface 53. As shown in FIGS. 4A and 5, the side seal member 61 includes a base material 61A having elasticity and a fabric member 61B which is laminated on the surface on the developing roller 31 side of the base material 61A. In the following description, only the side seal member 61 on the left side is described as a representative, and the description of the side seal member 61 on the right side will be omitted since it is just reverse of the side seal member 61 on the left side.

The base material 61A is formed of an elastic body such as an elastically-deformable urethane sponge and is stuck to the side seal sticking surface 53 of the casing 50 by a double-sided tape T1 to be adjacent to a lower end of the blade back seal 64. In FIG. 5, for ease of understanding, the double-sided tapes T1 and T2 are omitted.

Figure 4B:
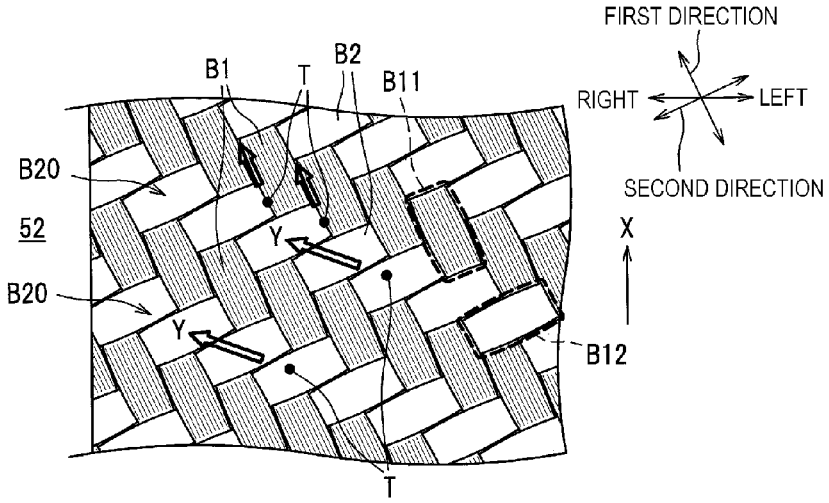
FIG. 4B is an enlarged view of a surface of a fabric member facing a developing roller.

The fabric member 61B is formed into a long sheet shape extending along a rotation direction X of the developing roller 31, as shown in FIGS. 4A and 4B, and is configured by interweaving a plurality of first fibers B1 extending in a first direction which is a direction inclined with respect to the left-right direction, and a plurality of second fibers B2 extending in a second direction which is a direction inclined with respect to the left-right direction, to intersect (cross) each other. The first direction refers to a direction which is directed, as proceeding toward the downstream side from the upstream side in the rotation direction X of the developing roller 31, from the left side to the right side, that is, from the outside in the left-right direction of the side seal member 61 to the inside. Further, the second direction refers to a direction which is directed, as proceeding toward the downstream side from the upstream side in the rotation direction X of the developing roller 31, from the right side to the left side, that is, from the inside in the left-right direction of the side seal member 61 to the outside.

With respect to the diameter of each of the fibers B1 and B2 of the fabric member 61B, the diameter of the first fiber B1 is about 150 μm and the diameter of the second fiber B2 is about 200 μm. Further, as the weave, twill weave or satin weave may be preferable. In this illustrative embodiment, the fabric member 61B is illustrated which is woven in twill weave configured such that the first fiber B1 overrides two adjacent second fibers B2 and then passes under two second fibers B2 adjacent thereto.

The plurality of first fibers B1 are provided adjacent to each other in the second direction (a direction in which the second fiber B2 extends) of the fabric member 61B, and the plurality of first fibers B1 are also provided in the thickness direction of the fabric member 61B. Further, the plurality of second fibers B2 are provided adjacent to each other in the first direction (a direction in which the first fiber B1 extends) of the fabric member 61B, and the plurality of second fibers B2 are also provided in the thickness direction of the fabric member 61B. Incidentally, for example, in FIG. 3, 5, or the like, the respective fibers B1 and B2 are appropriately omitted in consideration of the visibility of the drawing.

The fabric member 61B is woven such that in a surface B10 facing the developing roller 31, a portion where the first fiber B1 overrides the second fiber B2 (hereinafter referred to as a "first portion B11") protrudes further toward the developing roller 31 than a portion where the first fiber B1 passes under the second fiber B2 (hereinafter referred to as a "second portion B12"). The first portion B11 becomes a portion with which the developing roller 31 comes into sliding contact when the developing roller 31 rotates. That is, the first fiber B1 among the first fiber B1 and the second fiber B2 comes into sliding contact with the developing roller 31.

Further, a plurality of first portions B11 adjacent to each other in the second direction are arranged to be inclined to be located on the downstream side in the rotation direction X as proceeding toward the right side (the inside in the left-right direction) from the left side (the outside in the left-right direction). Further, accordingly, a plurality of second portions B12 adjacent to each other in the first direction are arranged to be inclined to be located on the downstream side in the rotation direction X as proceeding toward the right side from the left side, similar to the first portions B11. Then, a groove portion B20 which is recessed to the opposite side to the developing roller 31 is configured by the first portions B11 protruding further toward the developing roller 31 than the second portions B12, and the second portions B12 sandwiched between the first portions B11 on the upstream side and the downstream side in the rotation direction X of the developing roller 31.

The groove portion B20 extends in a direction in which the second portions B12 are arranged, that is, in a direction of an arrow Y which is directed from the left side (the outside in the left-right direction) to the right side (the inside in the left-right direction) as proceeding toward the downstream side from the upstream side in the rotation direction X.

Each of the fibers B1 and B2 has a circumferential surface in which a heat radiation amount per unit area is a first heat radiation amount, and an end surface in which a heat radiation amount per unit area is a second heat radiation amount larger than the first heat radiation amount. Specifically, as each of the fibers B1 and B2 having such properties, it is possible to adopt a fiber having a molecular structure in which molecules are arranged linearly, and it is possible to adopt, for example, an ultrahigh molecular weight polyethylene or polyparaphenylenebenzobisoxadole (PBO) fiber or the like. In addition, specifically, a fiber may be preferable in which thermal conductivity (at 100K) in a direction toward the end surface is equal to or greater than 0.1 W/cm·K and equal to or less than 1.0 W/cm·K, and is equal to or greater than two to 50 times of the thermal conductivity in a circumferential surface direction. In this illustrative embodiment, the Dyneema (registered trademark) SK60 fiber manufactured by Toyobo Co., Ltd. is used.

The fabric member 61B is formed with a fuzzy portion B30 which is formed such that the end surfaces of the respective fibers B1 and B2 face the heat radiation member 100 is formed on the left side in the surface B10 facing the developing roller 31, which is a portion coming into contact with the heat radiation member 100 (described later), that is, at an end portion on the outside in the left-right direction. In addition, the fuzzy portion B30 is formed by allowing the ends of the respective fibers B1 and B2 to rise to fuzz when cutting and forming the fabric member 61B to an appropriate size.

The fabric member 61B is formed to be longer than the base material 61A in the longitudinal direction and is stuck to the base material 61A and the blade back seal 64 by the double-sided tape T2.

<Heat Radiation Member>

The heat radiation member 100 is a member for radiating heat of the side seal member 61, as shown in FIGS. 3 and 5, and is formed in the form of a metallic plate. The heat radiation member 100 is disposed in contact with the end portion on the outside in the left-right direction of the surface B10 facing the developing roller 31 of the fabric member 61B at each of both right and left end sides of the developing roller 31.

The heat radiation member 100 is formed with a through-hole 101 through which a shaft 31B of the developing roller 31 passes in the left-right direction. The through-hole 101 is formed as a size such that the shaft 31B of the developing roller 31 passes therethrough. The shaft 31B passes through the through-hole 101, whereby the shaft 31B of the developing roller 31 comes into sliding contact with the through-hole 101 when the developing roller 31 rotates. That is, the heat radiation member 100 is in contact with the shaft 31B of the developing roller 31 via the through-hole 101.

The heat radiation member 100 is formed in a size with which the heat radiation member 100 is disposed within a range overlapping with the developing roller 31 when viewed from the left-right direction, and has an arcuate portion 110, a contact portion 120, a first inclined portion 130, and a second inclined portion 140 at an outline thereof.

The arcuate portion 110 is formed to have substantially the same shape as a circumferential surface corresponding to substantially lower half of the developing roller 31 and is in contact with the fabric member 61B. Specifically, the arcuate portion 110 is in contact with the end surfaces of the respective fibers B1 and B2 at the fuzzy portion B30 on the surface B10 facing the developing roller 31 of the fabric member 61B.

The contact portion 120 is formed into a substantial L-shape in a side view by a contact surface 121 extending downward from the vicinity of an upper end of the developing roller 31 and an extension surface 122 extending rearward from a lower end of the contact surface 121. Then, the above-described protrusion 55 is disposed on the rear side of the contact surface 121, that is, at a position capable of coming into contact with the contact surface 121 on the downstream side in the rotation direction X of the developing roller 31. In this way, even if the developing roller 31 rotates, whereby the heat radiation member 100 attempts to rotate following the rotation of the shaft 31B with which the heat radiation member 100 comes into contact, the contact surface 121 comes into contact with the protrusion 55, whereby the rotation of the heat radiation member 100 is restricted.

The first inclined portion 130 is formed to extend from a front end of the arcuate portion 110 to a position corresponding to the upper end of the developing roller 31 and is located further toward the shaft 31B than a portion coming into contact with the pressing member 32D of the layer thickness regulating blade 32, of the circumferential surface of the developing roller 31. In this way, the pressing member 32D of the layer thickness regulating blade 32 and the heat radiation member 100 do not interfere with each other.

The second inclined portion 140 is formed to extend from a rear end of the extension surface 122 of the contact portion 120 to a rear end of the arcuate portion 110 and is located further toward the shaft 31B than a portion coming into contact with the photosensitive drum 27, of the circumferential surface of the developing roller 31. In this way, the photosensitive drum 27 and the heat radiation member 100 do not come into contract with each other.

The heat radiation member 100 is not limited thereto and may be appropriately changed according to a usage mode and may also be fixed to an appropriate place such as the casing 50, for example.

An operation and effect of the developing cartridge 28 including the heat radiation member 100 configured as described above will be described.

As shown in FIG. 3, if the developing roller 31 rotates, both end portions of the developing roller 31 and the surfaces B10 facing the developing roller 31 of the fabric members 61B come into sliding contact with each other, and when heat is generated from a sliding contact portion between the developing roller 31 and the fabric member 61B, the heat is transmitted along the respective fibers B1 and B2. Then, the heat is efficiently transmitted from the fuzzy portion B30 in the respective fibers B1 and B2 to the heat radiation member 100 and radiated to the outside of the casing 50 through the shaft 31B of the developing roller 31. Therefore, according to this illustrative embodiment, it is possible to allow heat generated at the sliding contact portion between the developing roller 31 and the side seal member 61 to escape through the heat radiation member 100.

In addition, since the end surface on the inside in the left-right direction of the fabric member 61B of each of the fibers B1 and B2 at the fuzzy portion B30, that is, the end surface with which the heat radiation member 100 is not in contact is in contact with air, a heat radiation amount from the end surface is small, and thus the heat of the respective fibers B1 and B2 is transmitted toward the outside in the left-right direction of the fabric member 61B where temperature is relatively low.

Further, since the heat radiation member 100 comes into contact with the fuzzy portion B30 of the fabric member 61B, compared to, for example, a structure in which a heat radiation member comes into contact with only the circumferential surfaces of fibers configuring a planar surface of a fabric member, it is possible to allow heat transmitted to the respective fibers B1 and B2 to efficiently escape to the heat radiation member 100. In addition, since the heat radiation member 100 is disposed at an end portion of the side seal member 61 in the left-right direction, it is possible to allow heat in the end portion of the side seal member 61 to efficiently escape.

Further, since it is possible to bring the heat radiation member 100 into contact with the shaft 31B of the developing roller 31 only by passing the shaft 31B of the developing roller 31 through the through-hole 101, a structure can be simplified.

Further, as shown in FIG. 4B, since the groove portion B20 is configured in the fabric member 61B, the developing roller 31 comes into sliding contact with the fabric member 61B, whereby toner T enters the groove portion B20. The toner T moves from the upstream side in the rotation direction X to the downstream side, that is, in the direction of the arrow Y which is directed to an end portion on the downstream side of the groove portion B20, that is, to the inside in the left-right direction, according to the rotation of the developing roller 31. Then, the toner T is discharged from an end on the inside in the left-right direction of the groove portion B20 to the opening 52.

Further, the toner T which enters the groove portion B20 sometimes moves along the first direction. However, the toner T enters the groove portion B20 while moving inward in the left-right direction by the rotation of the developing roller 31 and is readily returned to the opening 52 through the groove portion B20.

Incidentally, in such a configuration, heat generated at the sliding contact portion between the side seal member 61 and the developing roller 31 flows toward the end portion of the side seal member 61 along directions in which the respective fibers B1 and B2 of the fabric member 61B extend. Then, in this illustrative embodiment, since the heat radiation member 100 is disposed at the end portion of the developing roller 31, it is possible to efficiently radiate the heat by the heat radiation member 100.

While the present invention has been shown and described with reference to certain illustrative embodiments thereof, it will be understood by those skilled in the art that various changes in form and details may be made therein without departing from the spirit and scope of the invention as defined by the appended claims.

Figure 6A:
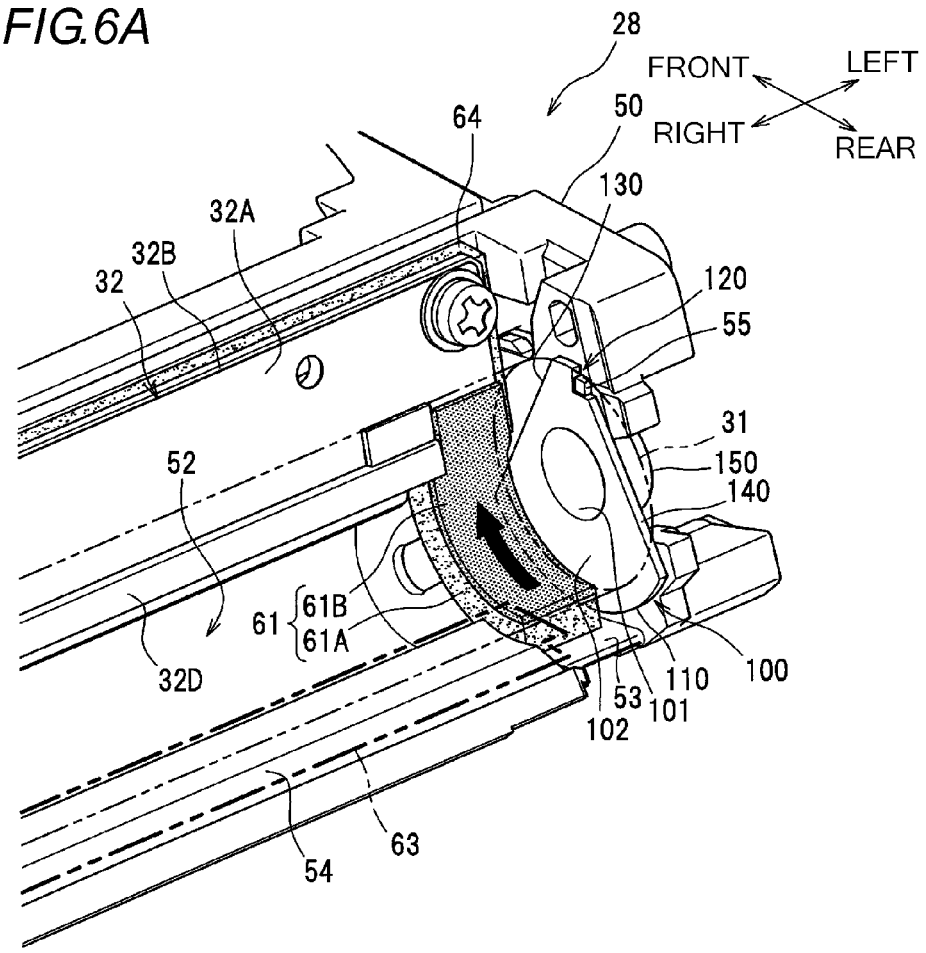
FIG. 6A is a diagram equivalent to FIG. 3 in a first modified illustrative embodiment.
Figure 6B:
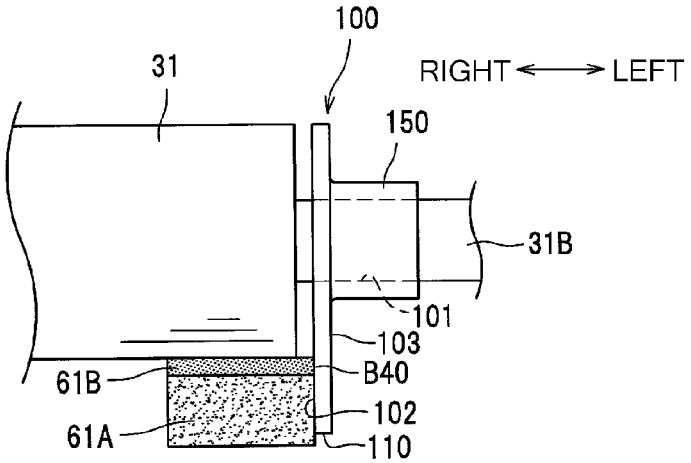
FIG. 6B is a diagram showing the periphery of a heat radiation member in the first modified illustrative embodiment when viewed from the rear side.

In the above-described illustrative embodiment, the heat radiation member 100 is in contact with the fuzzy portion B30 of the fabric member 61B. However, the present invention is not limited thereto. For example, the inventive concept of the present invention can be also applied to a configuration where the heat radiation member 100 comes into contact with a side surface B40 on the outside in the left-right direction of the fabric member 61B, as shown in FIGS. 6A and 6B.

The heat radiation member 100 in this configuration is formed into the form of a metallic plate, similar to the above-described illustrative embodiment, and is formed to have a size such that the arcuate portion 110 extends further to the lower side than the developing roller 31. Then, in the heat radiation member 100, at each of both right and left sides of the developing roller 31, a surface 102 of the heat radiation member 100 at the side of the developing roller 31 is in contact with the side surface B40 on the outside in the left-right direction of the fabric member 61B at the end portion on the outside in the left-right direction of the side seal member 61.

Further, the heat radiation member 100 has a bearing member 150 which is provided on an end portion of the shaft 31B of the developing roller 31, in addition to the configuration same as that in the above-described illustrative embodiment.

The bearing member 150 is configured integrally with the heat radiation member 100 and formed to protrude outward in the left-right direction from a surface 103 on the opposite side to the surface 102 of the heat radiation member 100 at the side of the developing roller 31. The bearing member 150 is formed at a position corresponding to the through-hole 101 of the heat radiation member 100 and supports the shaft 31B of the developing roller 31 passing through the through-hole 101. In this way, in comparison with a configuration in which the heat radiation member and the bearing member are separate bodies, the number of components can be reduced.

Even in such a configuration, it is possible to transmit heat generated from the sliding contact portion between the developing roller 31 and the fabric member 61B from the end surfaces of the respective fibers B1 and B2 to the heat radiation member 100, and it is possible to allow the heat to escape to the outside of the casing 50 through the heat radiation member 100.

Figure 7:
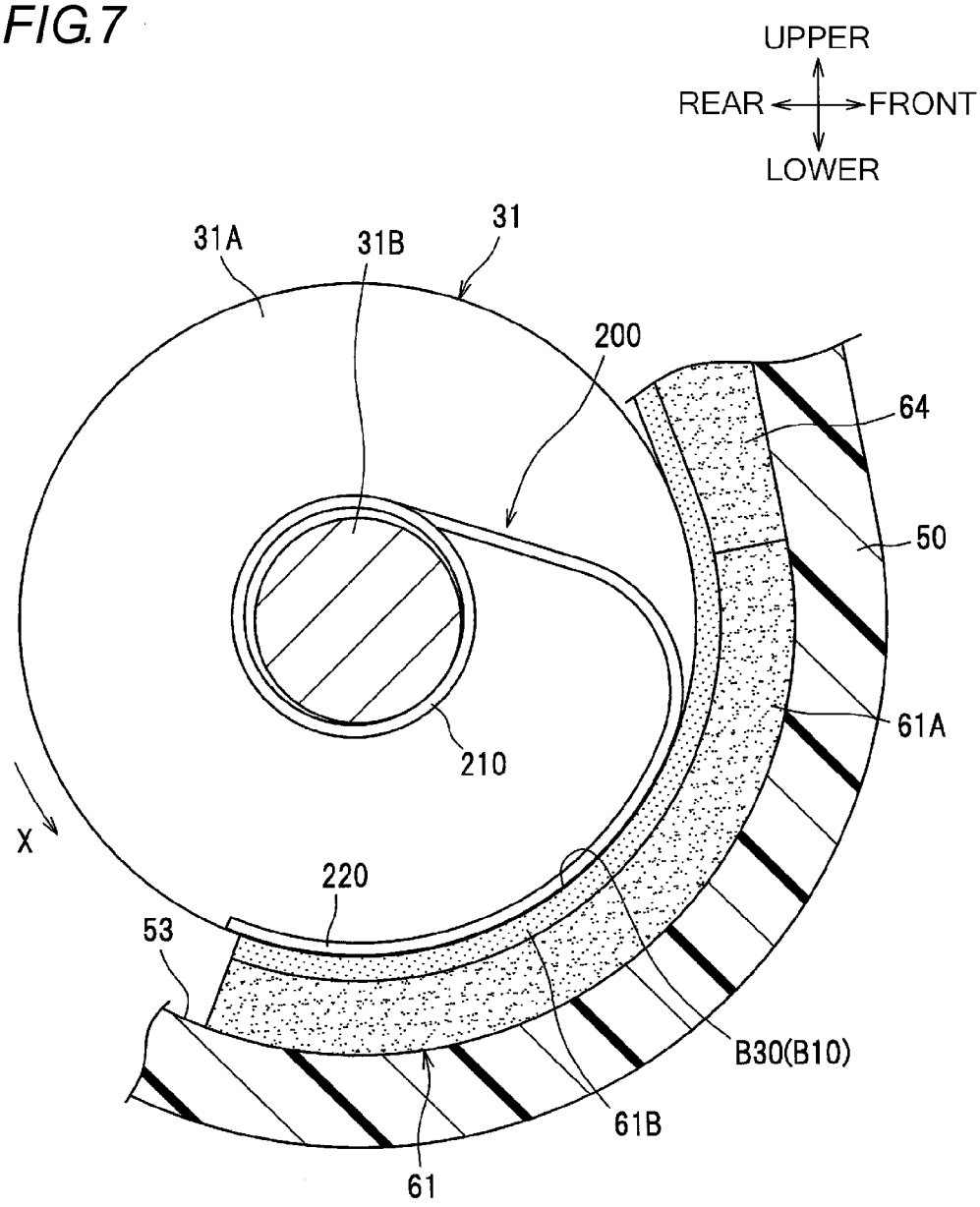
FIG. 7 is an enlarged cross-sectional view showing the periphery of a heat radiation member in a second modified illustrative embodiment when viewed from the left side.

In the above-described illustrative embodiment, the heat radiation member 100 is formed into the form of a plate. However, the present invention is not limited thereto. For example, the inventive concept of the present invention can be also applied to a configuration where the heat radiation member is made of a coil spring 200 (an example of a biasing member) as shown in FIG. 7.

The coil spring 200 is disposed at the end portion on the outside in the left-right direction of the side seal member 61, specifically, the position of the fuzzy portion B30 of the fabric member 61B and is configured to have a coil portion 210 and an arm portion 220.

The coil portion 210 is wound around the shaft 31B of the developing roller 31 and disposed to be able to come into contact with the shaft 31B.

The arm portion 220 extends forward and diagonally downward toward the fabric member 61B from the front and diagonally upper side of the coil portion 210 and then extends toward the upstream side from the downstream side in the rotation direction X of the developing roller 31 along the surface B10 facing the developing roller 31 of the fabric member 61B. The arm portion 220 is disposed in a state of being bent and deformed, thereby being biased toward the surface B10 facing the developing roller 31 of the fabric member 61B. In this way, the arm portion 220 is in contact with the fuzzy portion B30 of the surface B10 facing the developing roller 31 of the fabric member 61B.

In this manner, the arm portion 220 is biased toward the surface B10 of the fabric member 61B at the side of the developing roller 31, whereby the coil portion 210 is pressed toward the circumferential surface on the front and diagonally lower side of the shaft 31B due to a reaction force thereof. In this way, the coil portion 210 is in a state of being constantly in contact with the shaft 31B.

Then, it is possible to transmit heat generated from the sliding contact portion between the developing roller 31 and the fabric member 61B from the fuzzy portion B30 to the coil spring 200, and it is possible to allow the heat to escape to the outside of the casing 50 through the shaft 31B which comes into contact with the coil spring 200.

Figure 8:
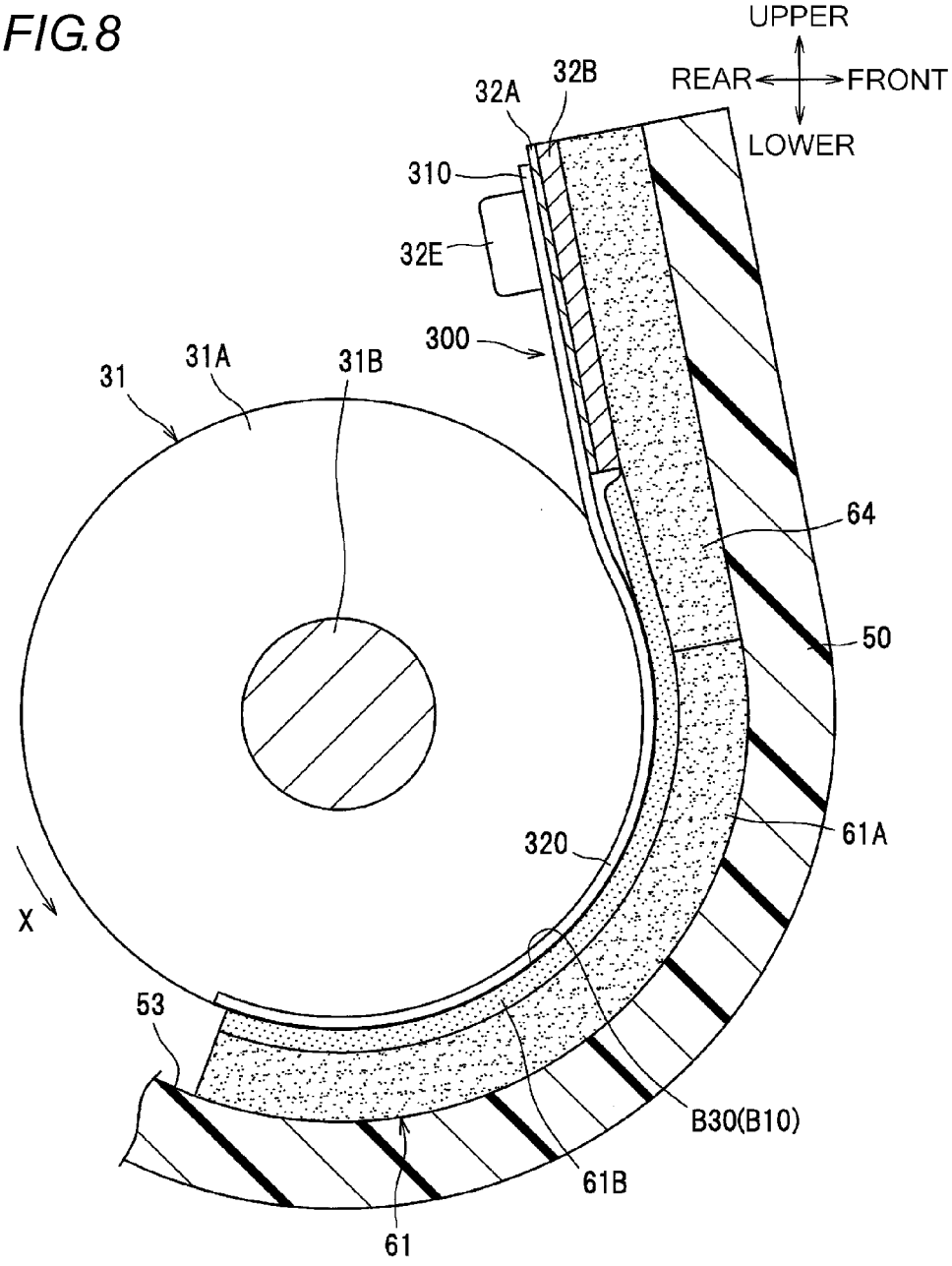
FIG. 8 is an enlarged cross-sectional view showing the periphery of a heat radiation member in a third modified illustrative embodiment when viewed from the left side.

In each illustrative embodiment described above, the heat radiation member is in contact with the shaft 31B of the developing roller 31. However, the present invention is not limited thereto, and, for example, the inventive concept of the present invention can be also applied to a configuration where the heat radiation member and a leaf spring 300 (an example of the biasing member) come into contact with the metal plate 32A of the layer thickness regulating blade 32, as shown in FIG. 8. FIG. 8 shows, for convenience, a state where the outer reinforcing plate 32C (refer to FIG. 2) is removed.

The leaf spring 300 is disposed at the end portion on the outside in the left-right direction of the side seal member 61, specifically, at the position of the fuzzy portion B30 of the fabric member 61B, and a base end portion 310 is fixed by a screw 32E to come into contact with the metal plate 32A. In the leaf spring 300, a tip portion 320 extends toward the upstream side from the downstream side in the rotation direction X of the developing roller 31 along the surface B10 facing the developing roller 31 of the fabric member 61B. The tip portion 320 of the leaf spring 300 is disposed in a state of being bent and deformed, thereby being biased toward the surface B10 facing the developing roller 31 of the fabric member 61B. In this way, the tip portion 320 is in contact with the fuzzy portion B30 of the surface B10 facing the developing roller 31 of the fabric member 61B.

Even in such a configuration, it is possible to transmit heat generated from the sliding contact portion between the developing roller 31 and the fabric member 61B from the fuzzy portion B30 to the leaf spring 300, and it is possible to allow the heat to escape to the outside of the casing 50 through the metal plate 32A which comes into contact with the leaf spring 300.

In each illustrative embodiment described above, the first fiber B1 and the second fiber B2 extend in a direction inclined with respect to the left-right direction. However, the present invention is not limited thereto, and for example, the first fiber B1 and the second fiber B2 may extend in a direction which is not inclined with respect to the left-right direction. That is, the inventive concept of the present invention can be also applied to a configuration where the first fiber B1 extends in the rotation direction X of the developing roller 31 and the second fiber B2 extends in the left-right direction, respectively.

In each illustrative embodiment described above, the developing cartridge 28 integrally having the toner accommodation chamber 34 is illustrated as the developing device. However, the present invention is not limited thereto, and the developing device may be, for example, a so-called process cartridge including a developing unit, a photosensitive drum on which a toner cartridge having a toner accommodation chamber is detachably mounted, and a developing roller.

In each illustrative embodiment described above, the laser printer is illustrated as an image forming apparatus on which the developing device is mounted. However, the present invention is not limited thereto, and other image forming apparatuses such as a color printer or a multifunction machine, for example, can be also employed.

In the illustrative embodiments described above, the side seal member 61 has a two-layer structure. However, the present invention is not limited thereto, and as long as it has a fabric member, a three or more layered structure can be also employed. Further, as long as it is a seal member which comes into sliding contact with a developing roller, the seal member is not limited to the side seal member 61, and for example, in a case where a seal member is provided in place of the lower film 63, the inventive concept of the present invention may be applied to the seal member.

The invention claimed is:

1. A developing device comprising:

a casing configured to accommodate developer;

a developing roller;

a seal member, at least a portion of which is disposed between the developing roller and the casing, the seal member including a fabric member having a plurality of first fibers extending in a first direction and a plurality of second fibers extending in a second direction different from the first direction, wherein the plurality of first fibers and the plurality of second fibers intersect each other, and each of the first fibers and the second fibers of the fabric member include a circumferential surface which has a first heat radiation amount per unit area, and an end surface having a second heat radiation amount per unit area larger than the first heat radiation amount per unit area; and a heat radiation member disposed at an end portion of the seal member in an axial direction of the developing roller and configured to contact the end surfaces of the first fibers and the second fibers.

2. The developing device according to claim 1, wherein the heat radiation member is disposed to come into contact with a facing surface of the fabric member, which faces the developing roller, wherein the fabric member includes a fuzzy portion in which the end surfaces of the first fibers and the second fibers face the heat radiation member, and wherein the fuzzy portion is in contact with the heat radiation member.

3. The developing device according to claim 1, wherein the heat radiation member is in contact with a side face of the fabric member at an outside in the axial direction of the developing roller.

4. The developing device according to claim 1, wherein the heat radiation member is in contact with a shaft of the developing roller.

5. The developing device according to claim 4, wherein the heat radiation member has a through-hole through which the shaft of the developing roller passes.

6. The developing device according to claim 4, wherein the heat radiation member includes a bearing member configured to receive an end portion of the shaft of the developing roller.

7. The developing device according to claim 1, wherein the heat radiation member is configured by a metal plate.

8. The developing device according to claim 1, wherein the heat radiation member is configured by a biasing member.

9. The developing device according to claim 1, wherein at least one of the first direction and the second direction is inclined with respect to the axial direction of the developing roller.

10. The developing device according to claim 9, wherein either of the first fibers or the second fibers which come into sliding contact with the developing roller extend in a direction which is directed inward from an outside of the seal member in the axial direction of the developing roller as proceeding toward a downstream side from an upstream side in a rotation direction of the developing roller.

* * * * *